United States Patent [19]

Marchesano

[11] Patent Number: 4,693,956

[45] Date of Patent: Sep. 15, 1987

[54] PROCESS FOR HIGH CONTRAST DEVELOPMENT OF PHOTOGRAPHIC ELEMENTS

[75] Inventor: Carlo Marchesano, Savona, Italy

[73] Assignee: Minnesota Mining and Manufacturing Company, St. Paul, Minn.

[21] Appl. No.: 798,751

[22] Filed: Nov. 15, 1985

[30] Foreign Application Priority Data

Nov. 16, 1984 [IT] Italy ..... 23619 A/84

[51] Int. Cl.[4] ..... G03C 5/24; G03C 1/06; G03C 1/00; G03C 5/30

[52] U.S. Cl. ..... 430/264; 430/265; 430/266; 430/267; 430/268; 430/438; 430/468; 430/481; 430/490; 430/599; 430/949

[58] Field of Search ..... 430/264, 265, 266, 267, 430/268, 949, 599, 468, 489, 490, 438, 481

[56] References Cited

U.S. PATENT DOCUMENTS

| | | | |
|---|---|---|---|
| 4,168,977 | 9/1979 | Takada et al. | 96/63 |
| 4,221,857 | 9/1980 | Okutsu et al. | 430/264 |
| 4,224,401 | 9/1980 | Takada et al. | 430/481 |
| 4,241,164 | 12/1980 | Mifune et al. | 430/264 |
| 4,269,929 | 5/1981 | Nothnagle | 430/481 |
| 4,272,606 | 6/1981 | Mifune et al. | 430/264 |
| 4,272,614 | 6/1981 | Mifune et al. | 430/441 |
| 4,323,643 | 4/1982 | Mifune et al. | 430/441 |

FOREIGN PATENT DOCUMENTS

| | | |
|---|---|---|
| 1146001 | 5/1983 | Canada . |
| 0155690 | 9/1986 | European Pat. Off. . |

*Primary Examiner*—John E. Kittle
*Assistant Examiner*—Mukund J. Shah
*Attorney, Agent, or Firm*—Donald M. Sell; James A. Smith; Mark A. Litman

[57] ABSTRACT

A process is disclosed for forming a high-contrast photographic image by developing a silver halide photographic element, including at least a silver halide emulsion layer, with an aqueous alkaline developing solution containing a dihydroxybenzene developing agent, a superadditive developing agent and an antioxidant at a pH of less than 12 in the presence of a hydrazine compound, an organic antifogging and contrast promoting agent selected within the class including a benzotriazole compound and a benzimidazole compound and a non polymeric hydroxymethylidyne group containing compound of formula:

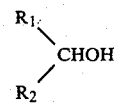

wherein $R_1$ and $R_2$ each independently represent a hydrogen atom, an aliphatic group, an aromatic group, a heterocyclic group, or $R_1$ and $R_2$ together complete a non aromatic cyclic group.

41 Claims, No Drawings

PROCESS FOR HIGH CONTRAST DEVELOPMENT OF PHOTOGRAPHIC ELEMENTS

FIELD OF THE INVENTION

The invention relates to a process for the development of photographic elements and, more particularly, to a process capable of producing a high constrast image in silver halide photographic elements used in the field of graphic arts.

BACKGROUND OF THE ART

In the process for forming a high contrast image by development of silver halide photographic elements necessary to produce useful images for graphic arts processes, special developers known in the art as "lith" developers are used. The high contrast is achieved by using the infectious development as described in Journal of the Franklin Institute, vol. 239, 221–230 (1945). These developers exhibit an induction period prior to the development of exposed silver halides, after which the infections development occurs, thus giving rise to high contrast.

The typical "lith" developers contains only a single developing agent of the dihydroxybenzene type, such as hydroquinone. In order to enhance the infectious development, "lith" developers contain an unusually low content of alkali sulfite. This sulfite content renders the developer more prone to aerial oxidation, especially when used in combination with processing machines and, more particularly, with rapid access processing machines, where the developer degradation is accelerated.

Moreover, the delay in the start of development caused by the long induction period of hydroquinone developers lengthens the processing time and delays access to the finished product. While the induction period has been eliminated and processing time has been reduced by the use of the so-called "rapic access" developers containing both hydroquinone and a superadditive developing agent such as phenidone or metol, these rapid access developers are not useful for lithographic purposes because they cannot produce the necessary high contrast. This is because rapic access developers have a high sulfite content which prevents infectious development and cause lower contrast than "lith" developers.

Processes for obtaining high contrast development of silver halide photographic emulsions have been disclosed by adding a hydrazine compound to the silver halide emulsion and developing the emulsion with a developer having a pH as high as 12.8. The use of hydrazine compounds allows the use of auxiliary developing agents in combination with the dihydroxybenzene developing agent in order to increase its development capacity. It also allows the use of relatively high sulfite concentrations to protect the developing agents against oxidation, thereby increasing the developer stability. However, the high pH level necessary to get the high contrast from the use of the hydrazine compound makes the relative life of the developing solution relatively short.

It is desirable to combine the high contrast of "lith" developers with the stability and processing speed of the rapid access developers, as described in U.S. Pat. No. 4,269,929. Reference can also be made to Japanese patent application Ser. No. J6 0093-433.

SUMMARY OF THE INVENTION

This invention is directed to a high speed, rapic access developer formulation having an improved resistance to air oxidation and producing a high contrast image suitable for lithographic purposes. Advantages such as high speed, high capacity, high degree of stability and high contrast can be achieved by developing a silver halide photographic element in the presence of a hydrazine compound, an effective amount of an organic antifogging agent and a contrast-promoting amount of a hydroxymethylidyne group containing compound with an aqueous alkaline developing solution which contains a combination of developing agents comprising a hydroquinone or substituted hydroquinone and at least one other superadditive developing agent and an effective amount of an antioxidant (such as sulfite compound), wherein the developing solution has a pH of less than about 12.

DETAILED DESCRIPTION OF THE INVENTION

The present invention refers to a process for forming a high-contrast photographic image by developing a silver halide photographic element, including at least a silver halide emulsion layer, with an aqueous alkaline developing solution containing a dihydroxybenzene developing agent, a superadditive developing agent and an antioxidant at a pH of less than 12 in the presence of a hydrazine compound, an organic antifogging agent selected within the class including a benzotriazole and a benzimidazole compound and a non polymeric hydroxymethylidyne group containing compound of the formula:

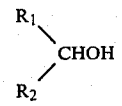

[1]

wherein $R_1$ and $R_2$ each independently represent a hydrogen atom, an aliphatic group, an aromatic group, a heterocyclic group, or $R_1$ and $R_2$ together complete a non aromatic cyclic group, preferably having together a total of at least 3 carbon atoms.

Preferably, in the method of the present invention, the aqueous alkaline developing solution has a pH not higher than 11.50 and, more preferably, above 9.50.

More preferably, the dihydroxybenzene developing agent is hydroquinone.

Still more preferably, the superadditive developing agent is a 3-pyrazolidone compound, in particular is 1-phenyl-3-pyrazolidone.

Preferably, within the method of the present invention the hydroxymethylidyne group containing compound has the formula [1] above, wherein $R_1$ represents an aromatic group and $R_2$ represents an aromatic group or an aliphatic group, $R_1$ and $R_2$ taken together being chosen to form a 3 to 7 carbon atom non aromatic cyclic group.

Particularly, according to the present invention, the hydroxymethylidyne group containing compounds are selected from the group consisting of methylphenylcarbinol, phenylethylcarbinol and phenylpropylcarbinol (including phenylcyclopropylcarbinol).

Photographic silver halide emulsions, which can be processed with the method of this invention to produce high contrast, comprise high chloride emulsions used in the lith films (e.g. containing mainly chloride with silver bromide and/or silver iodide in smaller amounts, such as those described in U.S. Pat. No. 3,785,822 and the references cited therein). However, the high contrast developing method of this invention can also be usefully employed also with any other type of negative acting, surface latent image, silver halide emulsions, for example silver bromide, silver bromo-iodide or silver chloro-bromide, silver chloro-iodide or silver chloro-bromo-iodide containing chloride in smaller ammounts than the "lith" emulsions.

To achieve the benefits of this invention, a hydrazine compound and a hydroxymethylidyne compound have to be present during the development of the exposed element. The hydrazine compound can be incorporated in the photographic element or in the developing solution or both in the photographic element and in the developing solution.

Hydrazine and any of a wide variety of water-soluble hydrazine derivatives are effective to enhance contrast when incorporated in the developing solution combined with the hydroxymethylidyne group containing compound according to this invention. Preferred hydrazine derivatives for use in the developing solution of this invention include compounds of formula:

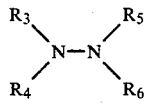

wherein $R_3$ is an organic radical and $R_4$, $R_5$ and $R_6$ each are hydrogen or an organic radical. Organic radicals represented by $R_3$, $R_4$, $R_5$ and $R_6$ include hydrocarbyl groups such as an alkyl group, an aryl group, an aralkyl group and an alicyclic group and such groups can be substituted with substituents such as alkoxy groups, carboxy groups, sulfonamido groups and halogen atoms.

Other examples of hydrazine derivatives, which can be incorporated in the developing solutions, are hydrazides, acyl hydrazides, semicarbazides, carbohydrazides and aminobiuret compounds.

Specific examples of hydrazine derivatives, which can be incorporated in the developing soluitions according to this invention, are disclosed in U.S. Pat. No. 2,419,575.

In a preferred form of this invention, the hydrazine compound is incorporated in the photographic element, for example in a silver halide emulsion layer of the photographic element or in a hydrophilic colloidal layer of the photographic element, preferably in a hydrophilic colloidal layer which is coated contiguously adjacent to the emulsion layer in which the effects of the hydrazine compound are desired. It can, of course, be present in the photographic element distributed between or among emulsion and hydrophilic colloidal layers, such as a subbing layer, interlayers and protective layers.

Hydrazine compounds suitable to be incorporated into the photographic element for use in the method of the present invention are disclosed in GB Pat. No. 598,108 and in U.S. Pat. No. 2,419,974; they include water-insoluble alkyl, aryl, heterocyclic hydrazines, as well as hydrazides, semicarbazides and aminobiuret compounds.

Particularly preferred hydrazine compounds, for use in the method of this invention incorporated in the photographic element, are the formyl hydrazine compounds corresponding to the formula:

$$R_7NHNHCHO$$

wherein $R_7$ represents a monocyclic or bicyclic aryl group as disclosed in U.S. Pat. No. 4,168,977 and in CA Pat. No. 1,146.001. The aryl group in this formula may be substituted with one or more substituents which are not electron-attracting, such as straight or branched-chain alkyl groups (e.g. methyl, ethyl, propyl, isopropyl, n-butyl, isobutyl, n-octyl, n-hexyl, tert.-octyl, n-decyl, n-dodecyl, etc.), aralkyl groups (e.g. benzyl, phenethyl, etc.), alkoxy groups (e.g. methoxy, ethoxy, 2-methyl-propyloxy, etc.), amino groups which are mono- or disubstituted with alkyl groups, aliphatic acylamino groups (e.g. acetylamino, benzoylamino, etc.), etc.

Other hydrazine compounds, for use in the method of this invention incorporated in the photographic element, are compounds represented by the formula:

$$R_7NHNHCOR_8$$

wherein $R_7$ represents the same monocyclic or bicyclic aryl group of the formula above and $R_8$ represents an alkyl group having 1 to 3 carbon atoms, which may be a straight or branched-chain alkyl (e.g. methyl, ethyl, n-propyl and isopropyl) or a phenyl group. The phenyl group may be substituted with one or more substituents which preferably are electron attracting groups, such as halogen atoms (chlorine or bromine, etc.), a cyano group, a trifluoromethyl group, a carboxyl group or a sulfo group, etc. Specific examples of hydrazine compounds represented by the formula above are disclosed in U.S. Pat. No. 4,224,401.

Still other examples of hydrazine compounds, for use in the method of the present invention incorporated in the photographic element, are those corresponding to the general formulas:

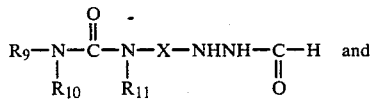

and

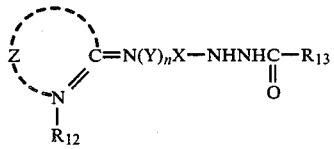

(respectively disclosed in U.S. Pat. Nos. 4,323,643 and 4,272,614) wherein $R_9$ and $R_{10}$ (which may be the same or different) each represent hydrogen, an aliphatic group (such as a straight or branched chain alkyl group, a cycloalkyl group, a substituted cycloalkyl group, an alkenyl group and an alkylnyl group), an aromatic group (such as a phenyl and naphthyl group) or a heterocyclic group; $R_{11}$ represents hydrogen or an aliphatic group (such as those listed above) and X represents a divalent aromatic group (such as a phenylene group, a naphthalene group and the analogous substituted groups thereof); $R_{12}$ represents a hydrogen atom, an aliphatic group which may be substituted; Y represents a divalent linking group; n represents 0 or 1; $R_{13}$ represents a hydrogen atom, an aliphatic group which may be susbtituted or an aromatic group which may be substituted and Z represents the non-metallic atom groups necessary to form a 5-membered or a 6-membered heterocyclic ring.

In one particular preferred form, the hydrazine compound to be incorporated in the photographic element is substituted with ballasting groups, such as the ballasting moieties of incorporated couplers and other non-diffusing photographic emulsion addenda. Said ballasting groups contain at least eight carbon atoms and can be selected from both aliphatic and aromatic relatively unreactive groups, such as alkyl, alkoxy, phenyl, alkylphenyl, phenoxy, alkylphenoxy and similar groups. Such hydrazine compounds can be incorporated in the photographic material using various methods well-known in the photographic art, the most common being the method of dissolving the hydrazine derivatives in a high-boiling crystalloidal solvent and dispersing the mixture in the emulsion, as described for example in U.S. Pat. No. 2,322,027.

Hydrazine compounds incorporated in the developing solution in the practice of this invention are effective at very low levels of concentration. For example, hydrazine compounds give effective results in the developing solution in an amount of about 0.001 moles per liter to about 0.1 moles per liter, more preferably in an amount from about 0.002 to about 0.001 moles per liter. Hydrazine compounds incorporated in the photographic element are typically employed in a concentration of from about $10^{-4}$ to about $10^{-1}$ mole per mole of silver, more preferably in an amount of from about $5\times10^{-4}$ to about $5\times10^{-2}$ mole per mole of silver, and most preferably in an amount of from about $8\times10^{-4}$ to about $5\times10^{-3}$ mole per mole of silver.

The dihydroxybenzene developing agents employed in the aqueous alkaline developing solutions of this invention are well-known and widely used in photographic processing. The preferred developing agent of this class is hydroquinone. Other useful dihydroxybenzene developing agents include chlorohydroquinone, bromohydroquinone, isopropylhydroquinone, tolylhydroquinone, methylhydroquinone, 2,3-dichlorohydroquinone, 2,5-dimethylhydroquinone, 2,3-dibromohydroquinone, 1,4-dihydroxy-2-acetophenone-2,5-dimethylhydroquinone, 2,5-diethylhydroquinone, 2,5-di-p-phenethylhydroquinone, 2,5-dibenzoylaminohydroquinone, 2,5-diacetaminohydroquinone, and the like.

The 3-pyrazolidone developing agents employed in the aqueous alkaline developing solutions of this invention are also well known and widely used in photographic processings. The most commonly used developing agents of this class are 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4,4-dihydroxymethyl-3-pyrazolidone. Other useful 3-pyrazolidone developing agents include 1-phenyl-5-methyl-3-pyrazolidone, 1-phenyl-4,4-dimethyl-3-pyrazolidone, 1-p-aminophenyl-4-methyl-4-propyl-3-pyrazolidone, 1-p-chlorophenyl-4-methyl-4-ethyl-3-pyrazolidone, 1-p-acetamidophenyl-4,4-diethyl-3-pyrazolidone, 1-p-betahydroxyethylphenyl-4,4-dimethyl-3-pyrazolidone, 1-p-hydroxyphenyl-4,4-dimethyl-3-pyrazolidone, 1-p-methoxyphenyl-4,4-diethyl-3-pyrazolidone, 1-p-tolyl-4,4dimethyl-3-pyrazolidone, and the like. The aqueous alkaline photographic developing compositions of this invention contain a sulfite preservative at a level sufficient to protect the developing agents against aerial oxidation and thereby promote good stability characteristics. Useful sulfite perservaatives include sulfites, bisulfites, metabisulfites and carbonyl bisulfite adducts. Typical examples of sulfite preservatives include sodium sulfite, potassium sulfite, lithium sulfite, ammonium sulfite, sodium bisulfite, potassium metabisulfite, sodium formaldehyde bisulfite salt, and the like. Also ascorbic acid is a known preservative agens against aerial oxidation of the developer for use in a bath of the present invention. The use of the hydroxymethylidyne group containing compound within the invention allows a high contrast to be obtained by developing the photographic element in the presence of a hydrazine compound, at a pH lower than the pH necessary to obtain the high contrast with the use of the hydrazine compound alone. Preferably, according to the present invention, such hydroxymethylidyne group containing compound is incorporated in the aqueous alkaline developing solution. As a consequence of a lower pH level, the effective life of such solution is highly enhanced. The aliphatic groups represented by each of $R_1$ and $R_2$ within the above formula [1] include a straight or branched chain alkyl group, a cylcoalkyl group, an akenyl group, an alkynyl group. Examples of straight or branched chain alkyl groups are alkyl groups each having from 1 to 10, and preferably from 1 to 5 carbon atoms, such as a methyl group, an ethyl group, a propyl group, a butyl group. Examples of cycloalkyl groups are those including 3 to 10 carbon atoms. Specific examples thereof are cyclopropyl and cyclohexyl groups.

The cycloalkyl group has generally from 3 to 10 carbon atoms. Preferred examples thereof are a cyclopentyl group, a cyclohexyl group, an adamantyl group.

Examples of aromatic groups shown by each of $R_1$ and $R_2$ include a phenyl group and a naphthyl group.

The heterocyclic ring group shown by each of $R_1$ and $R_2$ is a 5-membered or 6-membered single ring, or a condensed ring, having at least one of oxygen, nitrogen, sulfur and selenium atoms with or without substituents. Preferred examples of the heterocyclic groups are a pyrrolline ring, a pyridine ring, a quinoline ring, an indole ring, an oxazole ring, a benzoxazole ring, a naphthoxazole ring, an imidazole ring, a benzimidazole ring, a thiazoline ring, a thiazole ring, a benzothiazole ring, a naphthothiazole ring, a selenazole ring, a benzoselenazole ring, a naphthoselenazole ring, etc.

Of course, as known in the art, such described $R_1$ and $R_2$ substituents may be substituted with any substituents known in the art not to negatively affect the development process. Examples of such substituents could be alkyl, alkoxy and hydroxy substituents.

A parameter to take into proper account is the water solubility of the hydroxymethylidyne group containing compound. In order not to have them water-insoluble, it is preferred to keep the total number of carbon atoms in $R_1$ and $R_2$ to a value of less than 20 carbon atoms, preferably less than 15 carbon atoms.

Specific examples of hydroxymethylidyne group containing compounds which can be useful as contrast promoting agents to the purposes of this invention include the following:

| | |
|---|---|
| (1) methyl alcohol | (2) ethyl alcohol |
| (3) 1-propanol | (4) 2-propanol |
| (5) 1-butanol | (6) 2-methyl-1-propanol |
| (7) 3-methyl-1-butanol | (8) 2-propen-1-ol |
| (9) benzyl alcohol | (10) salicyl alcohol |
| (11) p-methoxy-benzyl alcohol | (12) β-phenethyl alcohol |
| (13) 1-phenyl-ethan-1-ol (phenyl-methylcarbinol) | |
| (14) benzhydrol (diphenylmethanol) | |
| (15) 3-phenyl-1-propen-1-ol (cinnamyl alcohol) | |
| (16) 4-diphenylmethanol | |
| (17) 1-phenyl-1,2-ethanediol (styrene glycol) | |
| (18) tetrahydrofurfuryl alcohol | (19) 1,2-ethanediol |
| (20) 1,2-propanediol | (21) 1,3-propanediol |
| (22) 1,2-butanediol | (23) 1,3-butanediol |
| (24) 1,4-butanediol | (25) 1,5-pentanediol |
| (26) 1,6-hexanediol | (27) pinacol |
| (28) 2-buten-1,4-diol | (29) 1,2-cyclohexanediol |
| (30) 1,4-cyclohexanediol | (31) 1,2,4-butanetriol |
| (32) phenylethylcarbinol | (33) phenylcyclopropylcarbinol. |
| (34) cycloheptanol | |
| (35) 1,2,3,4-tetrahydro-1-naphtol (α-tetralol). | |

The hydroxymethylidyne group containing compounds combined with the hydrazine compounds and the benzotriazole and benzimidazole antifogging agents of this invention produce a very high contrast, which means a contrast of at least 10. This contrast is the slope of the straight line portion of the characteristic curve (it is referred to as "average contrast") and is measured between two points located at densities of 0.10 and 2.50 above Dmin.

From the practical point of view of some applications in the field of graphic arts, it is preferred to have high contrast, that is a contrast of at least about 10, preferably higher than 10, also in the portion of the characteristic curve at densities higher than 2.50 (this contrast being referred to as "shoulder contrast"). It has been found that by selecting the hydroxymethylidyne group containing compound from the group consisting of phenylmethylcarbinol, phenylethylcarbinol and phenyl(cyclo)propylcarbinol a shoulder contrast of at least 10 can be obtained at lower pH values and lower amounts. It is believed, more in general, that good results can be obtained when compounds of formula |1| above are used wherein $R_1$ is an aromatic group (directly bonded to the CHOH residue) and $R_2$ (directly bonded to the CHOH residue) is an alkyl group or an aromatic group, or $R_1$ and $R_2$, taken together, form a non aromatic cyclic group of 3 to 7 carbon atoms (a fused nucleus such as in α-tetralol above is counted as having 6 carbon atoms).

The aqueous alkaline developing solutions of this invention can vary widely with respect to the concentration of the various ingredients included therein. Typically, the dihydroxybenzene developing agent is used in an amount of from about 0.040 to about 0.70 moles per liter, more preferably in an amount of about 0.08 to about 0.40 moles per liter; the 3-pyrazolidone developing agent is used in an amount of from about 0.001 to about 0.05 moles per liter, more preferably in an amount of from about 0.005 to about 0.01 moles per liter; the sulfite preservative is used in an amount of from about 0.03 to about 1.0 moles per liter, more preferably in an amount of from about 0.10 to about 0.70 moles per liter; and the hydroxymethylidyne group containing compound is used in an amount of from about 0.001 to about 3.00 moles per liter, more preferably in an amount of from about 0.01 to about 1.50 moles per liter.

In contrast with "lith" developers which require a low level of sulfite ion, the developing solutions of this invention can utilize higher levels of sulfite ions, and thereby achieve the advantage of increased stability, since a higher level of sulfite ions provides increased protection against aerial oxidation.

In carrying out the method of this invention, it is essential to employ an organic antifoggant and contrast promoting agent to minimize fog formation and to obtain the desired contrast. The organic antifoggant can be incorporated in the photographic element or can be added to the developing solution, the essential requirement being that it is present during the developing process. According to the present invention, in fact, it has been found that in absence of a benzotriazole and/or a benzimidazole antifogging and contrast promoting agent, high contrast values, as desired, cannot be obtained. Useful compounds are both unsubstituted and substituted compounds with the proviso that electro-withdrawing substituents at least as strong as nitro groups are excluded. As a matter of fact, nitro-substituted benzotriazole and benzimidazole compounds, although good to prevent fog, do not work to the purposes of the present invention. Although benzotriazole and benzimidazole compounds, as a class, are believed to be generally useful to the purposes of the invention, it is believed that any electron-withdrawing substituents at least as strong as nitro groups are not to be attached to the benzotriazole and benzimidazole compounds as used to the purposes of the present invention. Other substituents known in the art such as lower alkyl groups (having 1 to 5 carbon atoms) and halogen substituents (chlorine) proved to be substituents good to the purposes of the invention. Said benzotriazole and benzimidazole antifogging and contrast promoting agents are normally used in amounts effective to prevent fog although quantity can be optimized to get the best results from the contrast point of view. Useful quantities, when included in emulsion, may vary from 1 to 100 milligrams per 100 grams of emulsion and, when included in the developing bath, may vary from 0.01 to 5 grams per liter.

Photographic elements processed in the aqueous alkaline developing solutions of this invention comprise one or more layers formed from a negative silver halide emulsion comprised of a binder and radiation-sensitive silver halide grains capable of forming a surface latent image. The useful silver halide emulsions include the high chloride emulsions conventionally employed in forming "lith" photographic elements, as well as silver bromide and silver bromo-iodide emulsions, which are recognized in the art to be capable of attaining higher photographic speeds. Generally, the iodide content of the silver halide emulsions is less than about 10 mole percent silver iodide, based on the total silver halide. The silver halide emulsions are usually monodispersed or narrow grain size distribution emulsions as described for example in U.S. Pat. Nos. 4,166,742; 4,168,977; 4,224,401; 4,237,214; 4,241,164; 4,272,614 and 4,311,871. The silver halide emulsions may comprise a combination of silver halide emulsions having different grain size distribution, for example a combination of an emulsion having a mean grain size below 0.4 micron with an emulsion having a mean grain size above 0.7 micron as described in Japanese patent application Ser. No. 57-58137, or a combination of two emulsions both having a grain size below 0.4 micron, such as for example a first silver halide emulsion having a mean grain size of from 0.1 to 0.4 micron and a second silver halide emulsion of particles with a mean grain volume of less than one half of the particles of the first emulsion.

The silver halide grains of the emulsion are capable of forming a surface latent image, as opposed to those forming an internal latent image. Surface latent image silver halide grains are most employed in the negative type silver halide emulsions, while internal latent image-forming silver halide grains, though capable of forming a negative image when developed in an internal developer, are usually employed with surface developers to form direct-positive images. The distinction between surface latent image and internal latent imageforming silver halide grains is generally well-known in the art. Generally, some additional ingredient or step is required in the preparation of silver halide grains capable of preferentially formingan internal latent image instead of a surface latent image.

The silver halide emulsions can be spectrally sensitized with dyes from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls,, merostyryls and streptocyanines.

In addition ot the essential components specified hereinabove, the developing solutions of this invention can optionally contain any of a wide variety of addenda, as known, useful in photographic developing compositions. For example, they can contain solvents, buffers, sequestering agents, development accelerators, agents to reduce swelling of the emulsion layers, and the like.

In processing photographic elements with the developing solutions described herein, the time and temperature employed for the development can be varied widely. Typically, the development temperature will be in the range of from about 20° C. to about 50° C., more preferably in the range of from about 25° C. to about 40° C., while the development time will be in the range of from about 10 seconds to about 200 seconds, more preferably in the range of from about 60 seconds to about 150 seconds.

The present invention is further illustrated by the following procedure and examples.

The following black and white developer solutions (A to H) to be tested with the addition of the Contrast Promoting Agent (C.P.A.) compounds, according to the present invention, were prepared.

TABLE

| | | A | B | C | D | E | F | G | H |
|---|---|---|---|---|---|---|---|---|---|
| KOH (35% w/w) | ml | 60 | 175 | 150 | 130 | 140 | 130 | 135 | 210 |
| DTPA.5Na (40% w/w) | ml | — | 5 | 5 | 5 | 5 | 5 | 10 | 10 |
| EDTA.4Na | g | 1 | — | — | — | — | — | — | — |
| EDTA.4K (44% w/w) | ml | — | — | — | — | — | — | 3.5 | — |
| Lactic acid (80% w/w) | ml | — | — | — | 5 | 5 | — | — | — |
| $H_3PO_4$ (86% w/w) | ml | 2 | 40 | 30 | 15 | 15 | 15 | 15 | 38 |
| $Na_2SO_3$ | g | 92 | — | — | — | — | — | — | — |
| $K_2SO_3$ (43% w/w) | ml | — | 105 | 105 | 150 | 150 | 150 | 150 | 240 |
| KBr | g | — | 3 | 3 | 2.5 | 2.5 | 2.5 | 2.5 | 3 |
| KCl | g | — | 1.5 | 1.5 | — | — | — | — | 2 |
| Dimezone $S^{(R)}$ | g | — | 0.25 | 0.25 | 0.3 | 0.5 | 0.3 | 0.3 | 0.25 |
| Phenidone $Z^{(R)}$ | g | 0.4 | — | — | — | — | — | — | — |
| NaCNS | g | — | 0.10 | — | — | 0.15 | — | — | — |
| 5-methylbenzotriazole | g | 0.8 | 0.25 | 0.25 | 0.2 | 0.2 | 0.2 | 0.2 | — |
| K Hydroxyquinone monosulfonate | g | — | 13 | — | — | — | — | — | — |
| Hydroquinone | g | 30 | 30 | 35 | 25 | 25 | 25 | 25 | 30 |
| Water to make | ml | 1,000 | 1,000 | 1,000 | 1,000 | 1,000 | 1,000 | 1,000 | 1,000 |
| pH at 20° C. | | 11.90 | 11.12 | 11.60 | 11.70 | 12.10 | 11.94 | 11.86 | 11.50 |

The photographic film, to be tested with the developer solutions comprising the C.P.A. compounds according to the present invention, comprised a 0.25 micron cubic silver bromo-chloro-iodide emulsion (containing 70% bromide moles, 28% chloride moles and 2% iodide moles) coated on a polyester film support at 3.8 g/m$^2$ silver. The emulsion contained the hydrazine compound 1-formyl-2-{4-[2-(2,4-ditert.-pentylphenoxy)-butyramido]-phenyl}-hydrazide dispersed therein at the concentration of 1 g per silver mole and the sensitizing dye anhydrous 5,5-dichloro-9-ethyl-3,3'-bis-(3-sulfopropyl)-oxacarbocyanine hydroxide sodium salt. The emulsion layer was covered with a hardened protective layer containing gelatin hardened with bis-vinylsulfonylethyl ether hardener and a polymethylmethacrylate matting agent.

Samples of the film described above were exposed for 20 seconds to an EK 101 sensitometer through a 0.20 step wedge and an Inconel 2.27+B.G. 34 filter. The exposed samples were processed in the aqueous alkaline developing solutions of the following examples for 90" at 25° C. After development, the samples were fixed, washed and dried.

The following sensitomeric characteristics were evaluated: the minimum density (Dmin or fog), the maximum density (Dmax), the speed point (log 20/E, wherein E is expressed in lux-seconds, corresponding to a density of 0.20 above Dmin), the average contrast (AVERAGE $\gamma$) determined by the measuring the slope of the characteristic curve between two points located at densities of 0.10 and 2.50 above Dmin, and shoulder contrast (SHOULDER $\gamma$) determined by measuring the slope of the characteristic curve between two points located at densities of 1.60 and 4.00 above Dmin.

EXAMPLES 1–14

Samples of the film described above were processed according to the procedure set forth above. In the control test the developing solutions A to G described above were used at pH of 11.90 without any addition of C.P.A. compounds. In each of Examples 1 to 14, the developing solutions contained a C.P.A. compound as specified in Table I below. The same Table reports also the sensitometric results.

TABLE I

| Example no. | Developer solut.(s) | pH | C.P.A. Compound | Concentr. | Fog (Δ) | Dmax (Δ) | Speed point (Δ) | Average γ (Δ) |
|---|---|---|---|---|---|---|---|---|
| Control test | A + G | 11.90 | — | — | 0.04* (±0.01)** | 4.41* (±0.40)** | 1.22* (±0.09)** | 4.62* (±1.80)** |
| 1 | B | 11.90 | Methyl alcohol | 40 ml/l | 0.04 | 4.32 | 1.34 | 14.90 |
| 2 | B | 11.90 | Ethyl alcohol | 20 ml/l | 0.04 | 4.47 | 1.41 | 26.70 |
| 3 | B | 11.90 | 2-propanol | 20 ml/l | 0.04 | 4.70 | 1.43 | 24.10 |
| 4 | B | 11.90 | 2-propen-1-ol | 40 ml/l | 0.04 | 4.49 | 1.44 | 10.90 |
| 5 | A | 11.75 | Benzyl alcohol | 10 ml/l | 0.06 | 4.36 | 1.56 | 10.52 |
| 6 | B | 11.90 | β-phenethyl alcohol | 2 ml/l | 0.04 | 4.45 | 1.40 | 17.10 |
| 7 | B | 11.90 | Phenylmethylcarbinol | 2 ml/l | 0.06 | 4.79 | 1.57 | 16.50 |
| 8 | B | 11.90 | Benzydrol | 0.4 g/l | 0.04 | 4.11 | 1.52 | 19.50 |
| 9 | B | 11.90 | Styrene glycol | 6 g/l | 0.04 | 4.61 | 1.49 | 24.30 |
| 10 | E | 11.90 | 1,3-butanediol | 80 ml/l | 0.04 | 4.91 | 1.45 | 25.00 |
| 11 | D | 11.90 | 1,3-propanediol | 80 ml/l | 0.03 | 4.70 | 1.40 | 23.80 |
| 12 | D | 11.90 | 1,4-butanediol | 80 ml/l | 0.04 | 4.80 | 1.45 | 28.60 |
| 13 | D | 11.90 | 1,2-cyclohexanediol | 20 g/l | 0.04 | 4.64 | 1.34 | 14.10 |
| 14 | G | 11.90 | 1,2,4-butanetriol | 80 g/l | 0.03 | 4.90 | 1.33 | 13.10 |

* = Average value in A + G (Symbol A + G means "from A to G")
** = indicates the standard variation in A + G

EXAMPLES 15–23

Samples of the film described above were processed according to the procedure above. In each of Examples 15 to 23 the developing solutions contained a C.P.A. compound as specified in Table II below, which reports also the sensitometric results.

TABLE II

| Example no. | Developer solut.(s) | pH | C.P.A. compound | Concentr. | Fog (Δ) | Dmax (Δ) | Speed point (Δ) | Shoulder γ (Δ) |
|---|---|---|---|---|---|---|---|---|
| Control test | A + G | 11.90 | — | — | 0.04* (±0.01)** | 4.41* (±0.40)** | 1.22* (±0.09)** | 3.00* (±1.00)** |
| 15 | A | 12.00 | Methyl alcohol | 80 ml/l | 0.04 | 4.61 | 1.33 | 2.52 |
| 16 | B | 11.90 | β-phenethyl alcohol | 2 ml/l | 0.04 | 4.45 | 1.40 | 2.77 |
| 17 | B | 11.90 | Ethyl alcohol | 60 ml/l | 0.04 | 4.67 | 1.49 | 17.80 |
| 18 | B | 11.90 | Benzydrol | 4 g/l | 0.04 | 4.57 | 1.55 | 10.00 |
| 19 | B | 11.90 | Phenylmethylcarbinol | 2 ml/l | 0.06 | 4.79 | 1.57 | 22.30 |
| 20 | E | 11.90 | 1,3-butanediol | 80 ml/l | 0.04 | 4.91 | 1.45 | 21.50 |
| 21 | D | 11.90 | 1,4-butanediol | 80 ml/l | 0.04 | 4.80 | 1.45 | 20.30 |
| 22 | B | 11.90 | 1,5-pentanediol | 80 ml/l | 0.04 | 4.80 | 1.54 | 20.50 |
| 23 | F | 11.90 | 1,4-cyclohexanediol | 80 g/l | 0.04 | 4.71 | 1.46 | 11.60 |
| 24 | G | 11.90 | 1,5-pentanediol | 80 ml/l | 0.03 | 5.24 | 1.50 | 32.00 |

* = Average value in A + G
** = indicates the standard variation in A + G

EXAMPLES 25–31

Samples of the film described above were processed according to the procedure above. In each of Examples 25 to 31 the developing solutions contained a C.P.A. compound as specified in Table III below, which reports also the sensitometric results.

TABLE III

| Example no. | Developer solut.(s) | pH | C.P.A. compound | Concentr. | Fog (Δ) | Dmax (Δ) | Speed point (Δ) | Average γ (Δ) | Shoulder γ (Δ) |
|---|---|---|---|---|---|---|---|---|---|
| Control test | A + G | 11.90 | — | — | 0.04* (±0.01)** | 4.41* (±0.40)** | 1.22* (±0.09)** | 4.62* (±1.80)** | 3.00* (±1.00)** |
| 25 | B | 11.90 | Ethyl alcohol | 20 ml/l | 0.04 | 4.47 | 1.41 | 26.70 | 2.96 |
| 26 | B | 11.90 | Ethyl alcohol | 40 ml/l | 0.04 | 4.42 | 1.44 | 26.70 | 4.90 |
| 27 | B | 11.90 | Ethyl alcohol | 60 ml/l | 0.04 | 4.67 | 1.49 | 29.10 | 17.80 |
| 28 | B | 11.90 | Ethyl alcohol | 80 ml/l | 0.04 | 4.80 | 1.52 | 27.70 | 25.60 |
| 29 | B | 11.90 | Benzydrol | 0.4 g/l | 0.04 | 4.11 | 1.52 | 19.50 | 1.57 |
| 30 | B | 11.90 | Benzydrol | 2 g/l | 0.04 | 4.22 | 1.51 | 20.90 | 1.78 |
| 31 | B | 11.90 | Benzydrol | 4 g/l | 0.04 | 4.57 | 1.55 | 26.40 | 10.00 |

* = Average value in A + G
** = indicates the standard variation in A + G.

EXAMPLES 32–41

Samples of the film described above were processed according to the procedure above. In each of Examples 32 to 37 to developer solutions contained a C.P.A. Compound as specified in Table IV below, which also reports the sensitometric results.

TABLE IV

| Example no. | Developer solut.(s) | pH | C.P.A. compound | Concentr. | Fog (Δ) | Dmax (Δ) | Speed point (Δ) | Average γ (Δ) | Shoulder γ (Δ) |
|---|---|---|---|---|---|---|---|---|---|
| 32 | C | 11.70 | Ethyl alcohol | 120 ml/l | 0.04 | 4.77 | 1.40 | 17.40 | 8.66 |
| 33 | C | 11.90 | Ethyl alcohol | 120 ml/l | 0.04 | 4.77 | 1.48 | 29.90 | 37.90 |
| 34 | E | 11.70 | 1,3-butanediol | 80 ml/l | 0.04 | 4.73 | 1.33 | 12.00 | 4.11 |
| 35 | E | 11.90 | 1,3-butanediol | 80 ml/l | 0.04 | 4.91 | 1.45 | 25.00 | 21.50 |
| 36 | F | 11.90 | 1,3-butanediol and | 100 ml/l | 0.04 | 4.84 | 1.47 | 28.20 | 29.70 |

TABLE IV-continued

| Example no. | Developer solut.(s) | pH | C.P.A. compound | Concentr. | Fog (Δ) | Dmax (Δ) | Speed point (Δ) | Average γ (Δ) | Shoulder γ (Δ) |
|---|---|---|---|---|---|---|---|---|---|
| | | | phenylmethylcarbinol | 2 ml/l | | | | | |
| 37 | G | 11.70 | 1,3-butanediol and phenylmethylcarbinol | 100 ml/l 4 ml/l | 0.03 | 5.24 | 1.40 | 25.00 | 23.60 |
| 38* | H | 11.50 | 1,3-butanediol and phenylmethylcarbinol | 100 ml/l 2 ml/l | 0.03 | 4.94 | 1.36 | 16.90 | 13.90 |
| 39** | H | 11.50 | Phenylmethylcarbinol | 1.5 ml/l | 0.03 | 4.25 | 1.35 | 21.3 | 13.0 |
| 40** | H | 11.50 | Phenylcyclopropyl carbinol | 1.5 ml/l | 0.03 | 4.41 | 1.30 | 21.5 | 14.3 |
| 41*** | H | 11.50 | Phenylethylcarbinol | 1 ml/l | 0.03 | 4.91 | 1.22 | 20.30 | 21.80 |

*Devel. sol. comprising 0.2 g/l of 5-methylbenzotriazole antifogging agent and film developed for 60" at 30° C.
**Devel. sol. comprising 0.15 g/l of 5-methylbenzotriazole antifogging agent.
***Devel. sol. comprising 0.2 g/l of 5-methylbenzotriazole antifogging agent and film developed for 90" at 30° C.

EXAMPLES 42–48

Samples of the film described above were processed according to the procedure above. In each of Examples 42 to 48 developer solutions contained an organic antifoggant and a C.P.A. as specified in Table V below, which also reports the sensitometric results of the developed film.

TABLE V

| Example no. | Developer solution | pH | Organic antifoggant | Conc. g/lt | C.P.A. compound | Conc. g/lt | Fog (Δ) | Dmax (Δ) | Speed point (Δ) | Average γ (Δ) | Shoulder γ (Δ) |
|---|---|---|---|---|---|---|---|---|---|---|---|
| 42 | H | 11.50 | 5-methylbenzo-triazole | 0.2 | phenylmethyl-carbinol | 1 | 0.03 | 4.95 | 1.25 | 20.20 | 28.50 |
| 43 | H | 11.50 | benzotriazole | 0.2 | phenylmethyl-carbinol | 1 | 0.03 | 4.90 | 1.42 | 21.70 | 32.70 |
| 44 | H | 11.50 | 5-chlorobenzo-triazole | 0.2 | phenylmethyl-carbinol | 1 | 0.03 | 4.82 | 1.27 | 11.90 | 10.50 |
| 45 | H | 11.50 | benzimidazole | 0.2 | phenylmethyl-carbinol | 1 | 0.05 | 4.77 | 1.48 | 16.00 | 22.40 |
| 46 | H | 11.50 | 5,6-dimethyl-benzotriazole | 0.2 | phenylmethyl-carbinol | 1 | 0.03 | 4.79 | 1.28 | 17.40 | 12.40 |
| 47 | H | 11.50 | 5,6-dimethyl-benzimidazole | 0.2 | phenylmethyl-carbinol | 1 | 0.03 | 4.79 | 1.38 | 12.30 | 9.62 |
| 48 | H | 11.50 | 5-nitrobenzo-triazole | 0.2 | phenylmethyl carbinol | 1 | 0.04 | 4.66 | 1.22 | 3.41 | 4.32 |

What is claimed is:

1. A process for forming a high-contrast photographic image by developing a silver halide photographic element, including at least a silver halide emulsion layer, with an aqueous alkaline developing solution containing a dihydroxybenzene developing agent, a superadditive developing agent and an antioxidant at a pH of less than 12 in the presence of a hydrazine compound, an organic antifogging and contrast promoting agent selected within the class including a benzotriazole compound and a benzimidazole compound and a hydroxymethylidyne group containing compound of the formula:

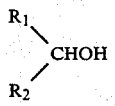

wherein $R_1$ and $R_2$ each independently represent a hydrogen atom, an aliphatic group, an aromatic group, a heterocyclic group, or $R_1$ and $R_2$ together complete a non aromatic cyclic group.

2. The process of claim 1 wherein the hydrazine compound is included in the silver halide emulsion layer.

3. The process of claim 1 wherein the hydroxymethylidyne group containing compound is included in the aqueous alkaline developing solution.

4. The process of claim 1 wherein the developing solution has a pH in the range of from 9.50 to 11.50.

5. The process of claim 1 wherein the dihydroxybenzene developing agent is hydroquinone.

6. The process of claim 1 wherein the superadditive developing agent is a 3-pyrazolidone developing agent.

7. The process according to claim 1 wherein the antioxidant is a sulfite compound.

8. The process according to claim 1 wherein the hydroxymethylidyne group containing compound has the formula:

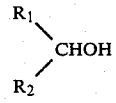

wherein $R_1$ represents an aromatic group and $R_2$ represents an aromatic group or an aliphatic group, $R_1$ and $R_2$, taken together, being chosen to form a 3 to 7 carbon atom non aromatic cyclic group.

9. The process according to any of the claim 1 wherein the hydroxymethylidyne group containing compound is selected from the group consisting of methylphenylcarbinol, phenylethylcarbinol and phenylpropylcarbinol.

10. The process according to claim 1 wherein the amount of said hydroxymethylidyne group containing compound and the pH of the developing solution are such as to produce a contrast of at least 10.

11. The process of claim 2 wherein the hydroxymethylidyne group containing compound is included in the aqueous alkaline developing solution.

12. The process of claim 2 wherein the developing solution has a pH in the range of from 9.50 to 11.50.

13. The process of claim 3 wherein the developing solution has a pH in the range of from 9.50 to 11.50.

14. The process of claim 2 wherein the dihydroxybenzene developing agent is hydroquinone.

15. The process of claim 3 wherein the dihydroxybenzene developing agent is hydroquinone.

16. The process of claim 4 wherein the dihydroxybenzene developing agent is hydroquinone.

17. The process of claim 13 wherein the dihydroxybenzene developing agent is hydroquinone.

18. The process of claim 2 wherein the superadditive developing agent is a 3-pyrazolidone developing agent.

19. The process of claim 11 wherein the superadditive developing agent is a 3-pyrazolidone developing agent.

20. The process of claim 17 wherein the superadditive developing agent is a 3-pyrazolidone developing agent.

21. The process according to claim 2 wherein the antioxidant is a sulfite compound.

22. The process according to claim 3 wherein the antioxidant is a sulfite compound.

23. The process according to claim 4 wherein the antioxidant is a sulfite compound.

24. The process according to claim 17 wherein the antioxidant is a sulfite compound.

25. The process according to claim 20 wherein the antioxidant is a sulfite compound.

26. The process according to claim 2 wherein the hydroxymethylidyne group containing compound has the formula:

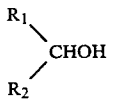

wherein $R_1$ represents an aromatic group and $R_2$ represents an aromatic group or an aliphatic group, $R_1$ and $R_2$, taken together, being chosen to form a 3 to 7 carbon atom containing non aromatic cyclic group.

27. The process according to claim 3 wherein the hydroxymethylidyne group containing compound has the formula:

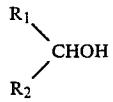

wherein $R_1$ represents an aromatic group and $R_2$ represents an aromatic group or an aliphatic group, $R_1$ and $R_2$, taken together, being chosen to form a 3 to 7 carbon atom containing non aromatic cyclic group.

28. The process according to claim 13 wherein the hydroxymethylidyne group containing compound has the formula:

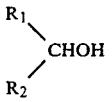

wherein $R_1$ represents an aromatic group and $R_2$ represents an aromatic group or an aliphatic group, $R_1$ and $R_2$, taken together, being chosen to form a 3 to 7 carbon atom containing non aromatic cyclic group.

29. The process according to claim 23 wherein the hydroxymethylidyne group containing compound has the formula:

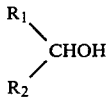

wherein $R_1$ represents an aromatic group and $R_2$ represents an aromatic group or an aliphatic group, $R_1$ and $R_2$, taken together, being chosen to form a 3 to 7 carbon atom containing non aromatic cyclic group.

30. The process of claim 2 wherein said benzotriazole compound and benzimidazole compound are without substituents as electron-withdrawing as nitro groups.

31. The process of claim 3 wherein said benzotriazole compound and benzimidazole compound are without substituents as electron-withdrawing as nitro groups.

32. The process of claim 4 wherein said benzotriazole compound and benzimidazole compound are without substituents as electron-withdrawing as nitro groups.

33. The process of claim 13 wherein said benzotriazole compound and benzimidazole compound are without substituents as electron-withdrawing as nitro groups.

34. The process of claim 16 wherein said benzotriazole compound and benzimidazole compound are without substituents as electron-withdrawing as nitro groups.

35. The process of claim 19 wherein said benzotriazole compound and benzimidazole compound are without substituents as electron-withdrawing as nitro groups.

36. The process of claim 22 wherein said benzotriazole compound and benzimidazole compound are without substituents as electron-withdrawing as nitro groups.

37. The process of claim 28 wherein said benzotriazole compound and benzimidazole compound are without substituents as electron-withdrawing ans nitro groups.

38. The process of claim 29 wherein said benzotriazole compound and benzimidazole compound are without substituents as electron-withdrawing as nitro groups.

39. The process of claim 1 wherein $R^1$ and $R^2$ are selected from the group consisting of H and alkyl of 1 to 10 carbon atoms.

40. The process of claim 4 wherein $R^1$ and $R^2$ are selected from the group consisting of H and alkyl of 1 to 10 carbon atoms.

41. The process of claim 20 wherein $R^1$ and $R^2$ are selected from the group consisting of H and alkyl of 1 to 10 carbon atoms.

* * * * *